United States Patent [19]

Tornberg

[11] Patent Number: 4,935,198

[45] Date of Patent: Jun. 19, 1990

[54] METHOD FOR THE POWDER-METALLURGICAL MANUFACTURE OF TUBES OR LIKE ELONGATED PROFILES

[75] Inventor: Claes Tornberg, Torshalla, Sweden

[73] Assignee: Avesta Nyby Powder AB

[21] Appl. No.: 188,335

[22] Filed: Apr. 29, 1988

[51] Int. Cl.[5] ..... B22F 7/00

[52] U.S. Cl. ..... 419/8; 419/48; 419/67; 419/68

[58] Field of Search ..... 419/8, 48, 68, 67

[56] References Cited

U.S. PATENT DOCUMENTS

| | | | |
|---|---|---|---|
| 3,615,382 | 10/1971 | Manilla et al. | 75/214 |
| 4,575,327 | 3/1986 | Borchert et al. | 419/49 |
| 4,602,952 | 7/1986 | Greene et al. | 419/49 |
| 4,604,252 | 8/1986 | Stigler | 419/68 |
| 4,722,825 | 2/1988 | Goldstein | 419/49 |

*Primary Examiner*—Stephen J. Lechert, Jr.
*Attorney, Agent, or Firm*—Andrus, Sceales, Starke & Sawall

[57] ABSTRACT

Method of and apparatus for powder-metallurgical manufacture of tubes or like elongated profiles, in which metal and/or metal alloy powder (3) is filled—if applicable with pre-compacting by means of vibrations or the like—into a thin-walled capsule, the latter is subsequently closed and cold and/or hot-pressed by means of universally acting isostatic pressure, and the thus obtained compact is further processed, especially extruded. For forming the tubular compact, the capsule filled with powder (3) after closing (cover 9; 9'; 9'') and isostatic pressing is centrally pierced (hole 26) by means of a mandrel (4, 5) whereby the powder (3) is correspondingly radially compacted from the inside towards the outside. The capsule features a cylindrical outer casing (8), a bottom (14) and a cover (9; 9'; 9'').

19 Claims, 2 Drawing Sheets

Figure 2:
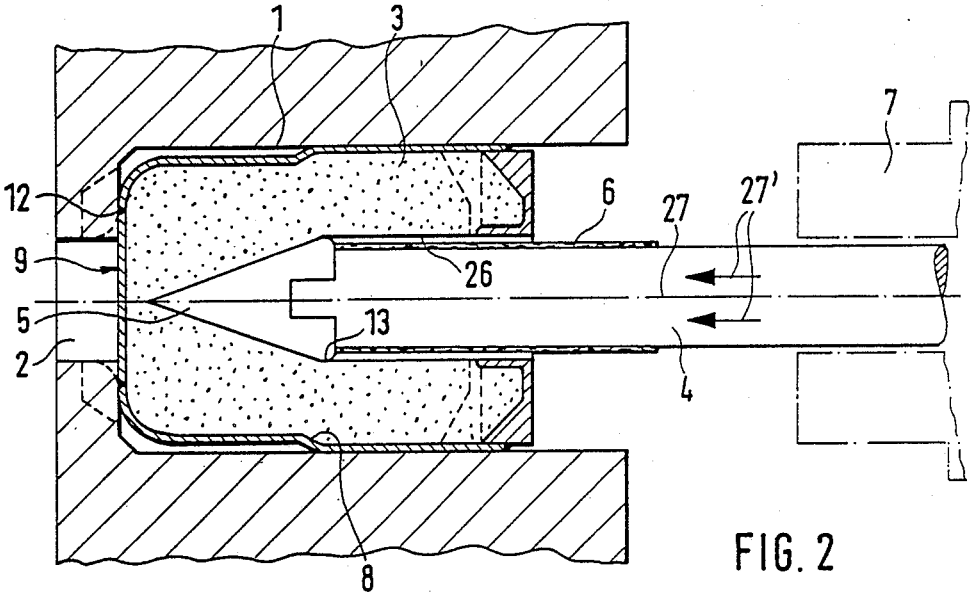

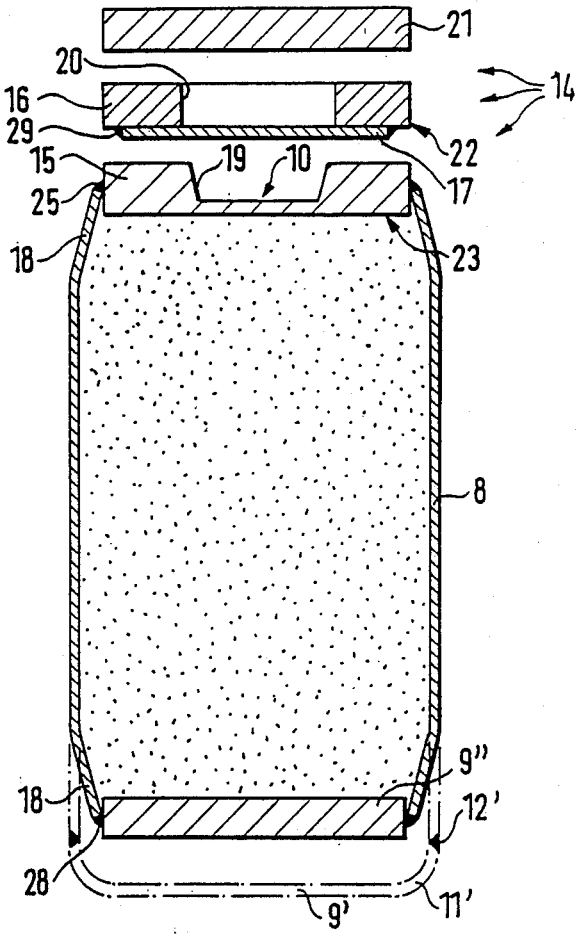
FIG. 3
FIG. 5
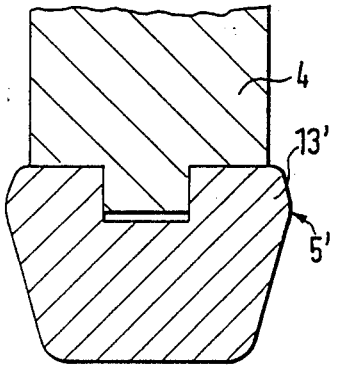
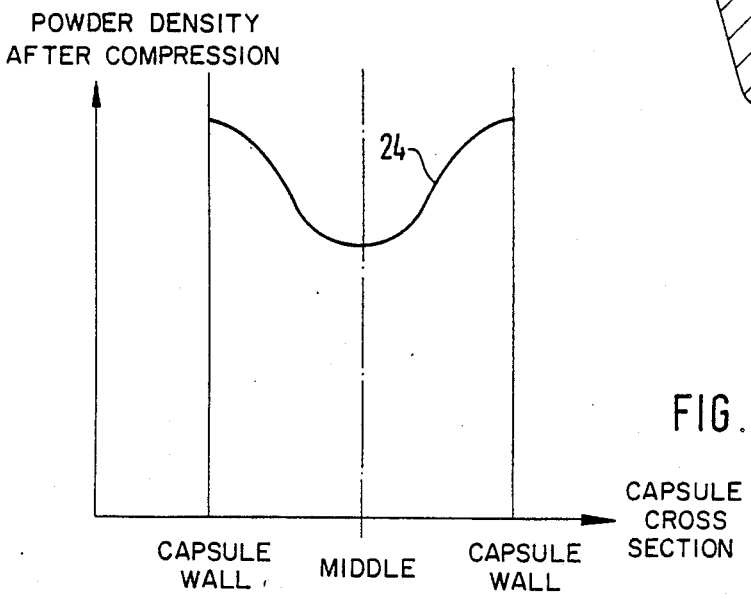
FIG. 4

METHOD FOR THE POWDER-METALLURGICAL MANUFACTURE OF TUBES OR LIKE ELONGATED PROFILES

The invention is directed to a method for the powder-metallurgical manufacture of tubes or like elongated profiles.

There are two basic methods of making tubular blanks of metal and/or metal alloys which are extruded to obtain tubes:

(a) mechanical working of a rolled or forged bar material to obtain the desired outer diameter of the blank to be extruded, and a centrally disposed longitudinal bore, the latter being formed by corresponding boring of the bar material;

(b) filling of a capsule having a cylindrical outer and inner casing of thin, ductile sheet metal with a powder made from metal and/or metal alloys, closing the capsule, and subjecting the capsule to isostatic pressure.

The last-mentioned method has proven highly advantageous. By extrusion of the powder-metallurgical tubular blanks or compacts it is possible to manufacture high-quality tubes. Since boring is not required for forming the central longitudinal bore, the usual losses of material resulting from boring can be avoided.

It is the object of the present invention to improve the last-mentioned method to the effect that the compact necessary for extrusion is obtained with still further reduced effort while being of the same or even better quality. The specified object is achieved, as regards the method, by the characterizing features of patent claim 1, the respective associated subclaims concerning advantageous further embodiments of the basic inventive concept.

Pre-compacting of the powder within the capsule is preferably conducted by means of ultrasonic vibration such that a powder density of about 70% of the theoretical density is obtained. Upon closure of the capsule, the same is exposed to universally acting, preferably cold-isostatic pressure so as to increase the powder density to about 95% of the theoretical density. Subsequently, the capsule is located in a cup-like receiving portion of an extruding press where it is pierced by means of a mandrel to form a central longitudinal hole. To this end the free end of the mandrel is provided with a tip of extremely resistant material, especially hard metal or ceramic. By this piercing operation the powder is additionally compacted radially from the inside towards the outside, whereby an especially uniform density across the capsule cross-section is obtained. Preferably, the capsule is pierced at elevated temperatures of e.g. 600° C. or in the range of the hot working or extrusion temperature, i.e. at a temperature of from about 1100° to 1200° C. In this case the extrusion may be performed immediately after piercing of the capsule.

The invention offers several unexpected advantages:

As already explained above, pressing of the mandrel into the powder-filled capsule results in additional compaction of the powder from the inside, whereby the density across the capsule cross-section is made uniform.

Moreover, pressing of the mandrel into the powder-filled capsule results in a kind of "pore closure" of the powder so that a capsule inner casing corresponding to the capsule outer casing need not be provided. Consequently, the welding operations required therefor, which in any case lead to a weakening of the capsule material, can be. Such weakened portions are accompanied by a risk of leakages.

The capsule to be pierced can be manufactured at significantly reduced costs as compared with the tubular capsules used so far, e.g. as disclosed in EP-A-20,536 or DE-A-2,419,014.

It is also possible to extrude increased numbers of tubes by employing the invention. The yield of finished faultless products is increase..

Pressing of the mandrel into the powder-filled capsule to obtain the central bore or hole is preferably effected by means of a vertical press, wherein the mandrel or at least the mandrel tip is mounted with a clearance so as to achieve high concentricity. The mentioned mandrel tip may be conical or frusto-conical.

Figure 1:
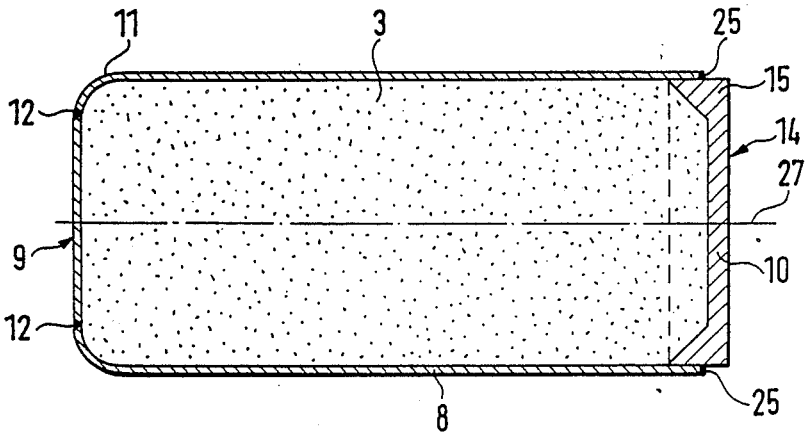

Below, the invention will be described in detail by means of schematically illustrated embodiments of capsules and an apparatus. In the drawing FIG. 1 is a schematic longitudinal sectional view of a first embodiment of a capsule;

FIG. 2 also is a schematic longitudinal sectional view showing the placement of the capsule of FIG. 1 in an apparatus for forming a central longitudinal hole; FIG. 3 shows several longitudinal sectional views of embodiments of capsules;

FIG. 4 illustrates the density across the cross-section of a cold-isostatically compacted capsule prior to forming the central hole; and FIG. 5 is a longitudinal sectional view of a modified embodiment of a mandrel for forming the central hole in a powder-filled capsule.

FIG. 1 is a schematic longitudinal sectional view of a capsule designed or used in accordance with the invention for making a tubular compact. Accordingly, the capsule comprises an outer shell 8 and a cover 9 each made from thin, ductile sheet metal and a somewhat thicker-walled bottom 14 the peripheral edge 15 of which is of reinforced design and in the present case extends prismatically inwardly, so that the inner area 10 of the bottom 4 has lesser thickness than the peripheral area. The bottom and cover are each welded to the outer casing (annular welds 12, 25). The cover could also be an integral part of the outer casing 8. Outer casing 8 and cover 9 would then preferably be made by deep-drawing.

In the illustrated embodiment, the end portion of the outer casing 8 which cooperates with the cover 9 is constricted radially inwardly to provide a radially inwardly extending circumferential curvature 11 along the inner edge of which the cover 9 is welded (weld 12). But it is similarly conceivable, as illustrated by the dashed lines in FIG. 3, to provide the cover 9' with a curved periphery 11' which is butt-welded to the outer casing 8 (weld 12' in FIG. 3). In the illustrated embodiment the bottom of the outer casing 8 is initially closed by a bottom plate 14. Subsequently the capsule is filled with metal powder, preferably while precompacting the same by means of ultrasonic vibrations. Thereby a powder density of up to about 75% of the theoretical density is achieved. Thereupon the capsule is closed by means of the cover 9 and is exposed to a universally acting cold-isostatic pressure so as to increase the powder density to an average of about 95% of the theoretical density, the density characteristic across the capsule cross-section corresponding to curve 24 in FIG. 4. This means that the powder density increases radially from the inside towards the outside. This density characteristic is of great significance for the further action on the capsule in accordance with the following description. In FIG. 1, the metal powder filling is referenced 3. The cold-isostatically pressed capsule is subsequently located in a cup-like receiving portion of a press which is not illustrated in detail in FIG. 2, into which a mandrel 4, 5 can be centrally moved to form a central capsule hole or bore 26. The mandrel 4, 5 cooperates with a central opening 2 in the bottom of the cup-like receiving portion 1, the mandrel 4, 5 being movable into said opening to form the mentioned capsule hole. The pressing-in motion of the mandrel 4, 5 is indicated in FIG. 2 by the arrows 27. Due to the fact that the powder is least compacted in the vicinity of the geometrical longitudinal axis 27 of the capsule, the mandrel 4, 5 is relatively easily pressed into powder-filled capsule. Thereby the powder is additionally radially compressed from the inside towards the outside with accompanying "pore closure" in the vicinity of the central inner hole 26. Thereby an approximately constant or uniform powder density is obtained across the cross-section of the then tubular compact. Due to the mentioned "pore closure", welding-in of an inner casing of thin, ductile sheet metal is not required. The compact made in accordance with the described method by means of the described apparatus can be directly extruded in the conventional way to form a finished tube.

As will be further apparent from FIG. 2, pressing-in of the mandrel 4, 5 takes place through the bottom 14 whereby the thin-walled inner area 10 is broken. During this operation the capsule and the metal powder 3 contained therein are subjected to an additional axial compacting force which leads to a slight deformation of the capsule, especially in the vicinity of the arcuate cover 11 or 11', respectively, where the powder can escape by corresponding deformation of the outer casing or cover, respectively.

The mandrel is composed of a shaft 4 and a tip 5 disposed on the free end of the shaft 4, the tip being conical in the embodiment illustrated in FIG. 2. The tip 5 is loosely fitted to the shaft 4, whereby high concentricity is obtained, on the one hand, and it becomes possible, on the other hand, to remove the tip 5 prior to retraction of the mandrel to the starting position (in opposition to the arrows 27) so that retraction of the mandrel is not obstructed by the tip 5. This measure is particularly advantageous when the circumference of the tip 5—as illustrated in FIG. 2 and also in FIG. 5—projects radially beyond the shaft 4.

The tip 5 is made from a high-strength material, especially hot-work tool steel, hard metal or ceramic. In accordance with FIGS. 2 and 5, the tip 5 or 5', respectively, is rounded on its peripheral edge 13 or 13' which faces the shaft 4 and slightly projects beyond the same. In the embodiment illustrated in FIG. 5, the tip 5' is of frustoconical design in contrast to the conical design of the tip 5 in the embodiment shown in FIG. 2.

The tip 5 or 5' and, if applicable, the shaft 4 are preferably provided with a lubricant, especially a fibre-glass stocking 6 fitted upon the tip 5 or 5' and, if applicable, also on the shaft 4. Glass lubricant is especially advantageous for so-called "hot piercing", i.e. when the hole 26 is made at an elevated temperature. Normally, it would be sufficient to provide only the tip 5 or 5' with a fibre-glass cap. But if it is desired that the piercing operation is immediately followed by extrusion, the shaft 4 will preferably also be provided with lubricant, e.g. with a fibre-glass layer.

The mandrel or, respectively, its shaft 4 is supported for longitudinal movement within a guide sleeve 7 of the press, which is not illustrated in detail in FIG. 2. The mandrel 4, 5 is preferably driven hydraulically in a manner known per se.

FIG. 3 schematically shows possible modifications of the powder capsule. The embodiment having the peripherally curved cover 9' has already been described in conjunction with the embodiment of FIG. 1.

Alternatively, the cover may be a relatively thick, rigid plate 9'' which is welded to the associated outer periphery of the outer casing 8 (annular weld 28).

As an alternative to the bottom of FIG. 1, the bottom 14 may be constituted by a plate 21 or a plate 23, the latter having a central recess 19 on the outside thereof, whereby the thickness of the bottom is correspondingly reduced in this area. As regards the effect of this embodiment, it corresponds to that illustrated in FIG. 1, the difference being that the recess 19 is provided on the outer side whereas in the embodiment of FIG. 1 it is provided on the inner side. A further alternative for the bottom 14 is characterized by a relatively thick annulus 16 the central opening of which is closed on the capsule inside by a thin-walled plate 17 so that the overall configuration is similar to the bottom plate 23 having the outside recess 19. The plate 17 is welded to the end face of the ring 16 on the capsule inner side (weld 29).

The end portions 18 of the outer casing 8 are of conically tapering design. The free space provided thereby inside the cup-shaped receiving portion 1 is filled during piercing of the capsule by corresponding expansion of the same. The capsule may expand into this free space. The conically tapering end portions 18 are no longer visible on the finished compact.

Of course, the bottom 14 can be made from the same sheet metal as the outer casing 8 similar to the cover 9 or 9' But it has been found that it is simpler and safer in respect of capsule tightness to weld thick-walled covers. But in that case the central area of the covers should be as thin-walled as possible for easier breaking and piercing by the mandrel 4, 5. Accordingly, it would be advantageous for the cover 9' in FIG. 3 also to have a configuration similar to the bottom plates 22, 23 or the bottom plate of FIG. 1, respectively. It should also be noted that all of the transitions between areas of different diameters both on the capsule and the mandrel, especially the mandrel tip 5 or 5', are of rounded or progressively varying configuration. Below, the benefits of the invention will be demonstrated by means of two examples:

Two capsules with an outer diameter of 222 mm and a length of 700 mm and a wall thickness of 2 mm were respectively filled with rustless 18/8-type powder. One capsule was closed at one end by a bottom plate having a thickness of 30 mm, the central area of said plate having a recess of a depth of about 25 mm. The diameter of the recess was 104 mm. The thickness of the plate in the vicinity of the recess therefore was 5 mm and had to be pierced by the piercing mandrel.

The other capsule was provide with a bottom plate of uniform thickness of 10 mm.

Both capsules were subjected to cold-isostatic pressure of 4000 bars.

After heating to 1150° C. the capsules were pierced in a vertical press. The obtained compacts exhibited a good inner surface and an eccentricity of the central hole of less than 4 mm.

After piercing, both compacts were extruded to form tubes having the following dimensions: 140×12 mm and 142×15 mm. The tubes exhibited good inner and good outer surface quality, a homogeneous structure and good mechanical properties.

All of the features disclosed in the present documents shall be claimed as being essential for the invention insofar as they are novel over the prior art either individually or in combination.

I claim:

1. A method for the powder-metallurgical manufacture of a tubular member comprising the steps of:

filling a thin-walled capsule with a powder comprising at least one of a metal and a metal alloy;

subsequently closing the capsule;

compressing the closed capsule by means of a universally acting isostatic pressure to compact the powder in the capsule; and centrally piercing the closed capsule by means of a mandrel for radially compacting the powder from the inside to the outside of the capsule and to obtain a tubular member.

2. The method as claimed in claim 1 further including the step of precompacting the powder prior to closing the capsule.

3. The method as claimed in claim 2 further defined as precompacting the powder as the container is being filled.

4. The method as claimed in claim 2 further defined as precompacting the powder to a density of at least about 70% of the theoretical density.

5. The method as claimed in claim 2 further defined as precompacting the powder by means of vibrations.

6. The method as claimed in claim 5 further defined as precompacting the powder by means of ultrasonic vibrations.

7. The method as claimed in claim 1 further defined as cold compressing the capsule.

8. The method as claimed in claim 1 further defined as hot compressing the capsule.

9. The method as claimed in claim 1 further defined as compressing the capsule to compact the powder to an average density of at least about 80% to 95% of the theoretical density.

10. The method as claimed in claim 1 further defined as piercing the capsule at elevated temperatures.

11. The method as claimed in claim 10 further defined as piercing the capsule at a temperature of about 600C.

12. The method as claimed in claim 10 further defined as piercing the capsule at a temperature of between 1100° C. and 1200° C.

13. The method as claimed in claim 1 further defined as locating the capsule in a cup-like receptacle prior to piercing with the mandrel, the bottom of the receptacle being provided with a central opening for passage of the mandrel.

14. The method as claimed in claim 1 wherein the capsule is pierced using a lubricant in conjunction with the mandrel.

15. The method as claimed in claim 14 wherein the capsule is pierced using a glass lubricant.

16. The method as claimed in claim 15 further defined as using a fiber glass covering for the mandrel.

17. The method as claimed in claim 1 further including the step of additionally processing the tubular member.

18. The method as claimed in claim 17 further defined as extruding the tubular member.

19. A method for the powder-metallurgical manufacture of a tubular member comprising the steps of:

filling a thin-walled capsule with a powder comprising at least one of a metal and a metal alloy;

precompacting the powder in the capsule by means of vibrations;

subsequently closing the capsule;

cold compressing the closed capsule by means of a universally acting isostatic pressure to compact the powder in the capsule; and centrally piercing the closed capsule at elevated temperatures by means of a mandrel for radially compacting the powder from inside to the outside of the capsule and to obtain a tubular member.

* * * * *